US010718582B2

(12) United States Patent
Sharkov et al.

(10) Patent No.: US 10,718,582 B2
(45) Date of Patent: Jul. 21, 2020

(54) MAGAZINE FOR SMALL ARMS

(71) Applicants: Oleksii Oleksandrovych Sharkov, m. Kyiv (UA); Georgii Georgiiovych Makarov, m. Kyiv (UA); Hlib Georgiiovych Makarov, m. Kyiv (UA); Kostiantyn Okrevych Trypolskyi, m. Kyiv (UA); Serhii Anatoliiovych Babenko, m. Dnipro (UA); Sergii Pavlovych Zibrov, m. Kyiv (UA)

(72) Inventors: Oleksandr Kostiantynovych Sharkov, m. Kyiv (UA); Georgii Georgiiovych Makarov, m. Kyiv (UA); Hlib Georgiiovych Makarov, m. Kyiv (UA); Kostiantyn Okrevych Trypolskyi, m. Kyiv (UA); Serhii Anatoliiovych Babenko, m. Dnipro (UA); Sergii Pavlovych Zibrov, m. Kyiv (UA)

( * ) Notice: Subject to any disclaimer, the term of this patent is extended or adjusted under 35 U.S.C. 154(b) by 0 days.

(21) Appl. No.: 16/346,276

(22) PCT Filed: Dec. 22, 2016

(86) PCT No.: PCT/UA2016/000150
§ 371 (c)(1),
(2) Date: Apr. 30, 2019

(87) PCT Pub. No.: WO2018/106205
PCT Pub. Date: Jun. 14, 2018

(65) Prior Publication Data

US 2019/0264995 A1 Aug. 29, 2019

(30) Foreign Application Priority Data

Dec. 7, 2016 (UA) ..... 2016-12453

(51) Int. Cl.
*F41A 9/69* (2006.01)
*F41A 9/65* (2006.01)
(Continued)

(52) U.S. Cl.
CPC *F41A 9/69* (2013.01); *F41A 9/00* (2013.01); *F41A 9/61* (2013.01); *F41A 9/65* (2013.01)

(58) Field of Classification Search
CPC ..... F41A 9/61; F41A 9/64; F41A 9/65; F41A 9/69; F41A 9/70; F41A 9/71
See application file for complete search history.

(56) References Cited

U.S. PATENT DOCUMENTS 2,217,848 A 10/1940 Schillstrom
2,296,729 A * 9/1942 Mossberger ..... F41A 9/71 42/50
(Continued)

FOREIGN PATENT DOCUMENTS

RU 2 158 890 C1 11/2000
RU 2 422 748 C1 6/2011
(Continued)

OTHER PUBLICATIONS

International Search Report dated Sep. 7, 2017, issued in counterpart International Application No. PCT/UA2016/000150 (2 pages).

*Primary Examiner* — Derrick R Morgan
(74) *Attorney, Agent, or Firm* — Westerman, Hattori, Daniels & Adrian, LLP

(57) ABSTRACT

A magazine for small arms is disclosed including box (1), bottom lid (2) with opening, ammunition (3), magazine follower (4), coil spring (6), where between the follower (4) and the coil spring (6) a disk (5) with a rectangular through hole (17) is made, which presses the upper end of the coil spring (6) to the follower (4), the ammunition stream separator (7). In addition there are grooves (8) along the wide
(Continued)

side walls of the magazine box (1), on the inner surfaces facing the ammunition (3) a ground surface (9) is made, wherein in the lower part of the box of the magazine, on the outer surface there is a triangular ledge (12), and in upper part of magazine box (1) on wide side walls there are rigidly fixed plate inserts (10), on which the feeding projections (14) are made, the polished section (15) and the conical section (16).

25 Claims, 16 Drawing Sheets

(51) Int. Cl.
*F41A 9/61* (2006.01)
*F41A 9/00* (2006.01)

(56) References Cited

U.S. PATENT DOCUMENTS 3,789,531 A * 2/1974 Kersten ..... F41A 9/65 42/87
3,857,324 A * 12/1974 Tant ..... F41A 9/65 89/197
4,589,218 A * 5/1986 Teppa ..... F41A 9/69 42/50
4,888,900 A 12/1989 Howard
5,149,897 A 9/1992 Howard
8,776,419 B2 * 7/2014 Obermeit ..... F41A 9/69 42/49.01
9,523,546 B1 * 12/2016 Harding ..... F41A 9/70
2010/0269389 A1 * 10/2010 Lopez Laparra ..... F41A 9/68 42/49.01
2011/0173857 A1 * 7/2011 Hogan, Jr. ..... F41A 9/68 42/50
2011/0214326 A1 * 9/2011 Inskeep ..... F41A 9/61 42/49.02
2012/0131831 A1 * 5/2012 Sullivan ..... F41A 9/69 42/50
2014/0075808 A1 * 3/2014 Ballard ..... F41A 9/70 42/49.01
2014/0202056 A1 * 7/2014 Ball ..... F41A 9/70 42/1.02
2015/0192377 A1 * 7/2015 Larson, Jr. ..... F41A 9/70 42/50
2019/0264995 A1 * 8/2019 Sharkov ..... F41A 9/65

FOREIGN PATENT DOCUMENTS

RU 2 554 030 C1 6/2015
RU 2 592 185 C2 7/2016

* cited by examiner 2-2

MAGAZINE FOR SMALL ARMS

The proposed invention relates to firearms, namely, to the box magazines with cartridge followers, and can be used in particular in automatic small weapons.

A magazine for small arms is known from the prior art (Patent RU no. 2158890, IPC F4A9/65, publ. 10 Nov. 2000), comprising a body with a receiver, a box-type follower arranged inside the body, on which two ramming devices are hinged, a spring located between the follower and the magazine base, and the ammunition stream separator placed on the walls of the body in its narrowing part, in which the ammunition stream separators are made in the form of diamond-shaped projections on the front and rear walls of the body with the formation between the lateral edges of the diamond-shaped projections and the body of two single-row channels to the receiver, while the box-type follower is made with a side reach-through window and two adjacent upper pads displaced throughout the height of ¼ diameters of the used cartridge, and rammers installed in the window of the follower so that the upper surface of one of the rammers projects above a higher platform of the follower, and the upper surface of the other rammer is buried under it. The disadvantage of the known technical solution is that:

- in the magazine receiver, the five upper ammunition with staggered order have a thrust, additionally supported by two ammunition entering the diamond-shaped projection, and have an angle of approximately 10-15 degrees to vertical axis of box-type body, which transmits the feed force at an angle, thereby increasing the thrust in the five upper ammunition;
- all ammunition below the $7^{th}$ in a staggered order may have thrust, as the ammunition have admissions at manufacturing, so in such a magazine a highly non-uniform thrust force is produced;
- right and left rammers are provided with lever projections whose ends are spring-loaded and automatically select gaps in outer rows with the four-row arrangement of ammunition, which results in the appearance of thrust and an increase of friction during operation of the magazine in the inner rows ammunition, which making worse its operation;
- free space is formed between diamond-shaped projections and triangular inserts, in this case, the ammunition located there partially overlapping it. Trash (dust, dirt, sand, etc.) will pass into the remaining free space and depose on the ammunition in a four-row arrangement. Trash will increase the friction by accumulating on the ammunition on the friction surfaces that can lead to cessation of magazine operation;
- the complexity of the construction, which consists of a large number of parts (diamond-type projections, triangular inserts in magazine box, box-type follower, which has right and left rammers with lever projections) with a complex configuration, and a complex scheme of ammunition rearrangement, which will lead to the rising of high resistant forces of ammunition rearrangement and reduction of reliability, especially under difficult usage environment (dust, dirt, sand, etc.).

Also known is a box magazine (Patent RU no. 2554030, IPC F4A9/69, publ. 20 Jun. 2015), comprises a body, a follower spring, and follower. The thickness of the magazine is 1.87-2.7 D (diameter of the bullet casing bottom) from the inside. The magazine also has two springs on the follower, the force of which is directed upward. In the second embodiment, a rocker is arranged crosswise on the follower and made in the form of double-arm equal-arm lever, to one end of which the support is fixed with the height of 0.5 D. The disadvantage of the known technical solution is that:

- all ammunition below 4th are in staggered order and it is possible that they can jam. Jamming occurs because the magazine thickness (the size of the orthogonal axis of the ammunition) is 2.7 D from the inside, where D is the diameter of the bullet casing bottom, plus a small technological gap, and therefore two vertical rows of ammunition can move relative to each other and turn into a wedge;
- a cavity for storing dust, dirt, sand and the like is not provided in the magazine and thus all of this accumulating on the ammunition on the friction surfaces will increase the friction which can lead to cessation of operation of the magazine;
- the complexity of the construction of the feeding mechanism consisting of a large number of parts (follower, rocker with a support, two springs)), their complex configuration, complex wedge-shaped with the curvature of the scheme of the rearrangement of cartridges, which will lead to the rising of high resistant forces of rearrangement of cartridges and reduces the reliability, especially under difficult operating conditions (dust, dirt, sand, etc.).

A magazine for small arms is known (Patent RU no. 2422748, IPC F4A9/71, publ. 27 Jun. 2011), which comprises a box-type body with bends in the upper part for holding the cartridges, cartridge follower with projection on the upper surface, spring, lid and cartridges arranged in double rows in staggered order. Recesses are made along the longitudinal axis of symmetry of the magazine body in the front and rear walls along with the whole height of the magazine, in which the give part of the bullet and the cartridge rim with the long bullet are placed. There is a transverse groove in the middle part of the projection on cartridge follower, in which spring-loaded slider is installed with the possibility of movement along the groove and interaction with the cartridge. The side surface of the slider faced to the cartridge and skewed at a close angle. The upper surface of the slider, as the part of the cartridge follower positioned in the recess in the rear part of the magazine, is made flush with the projection on the upper surface of the cartridge follower. One of the disadvantages of this magazine is that the magazine is not provided with a cavity for storing dust, dirt, sand and the like, and thus all of this accumulating on the ammunition on the friction surfaces will increase the friction which can lead to cessation of operation of the magazine.

The closest analog of the proposed magazine for small arms is the magazine in U.S. Pat. No. 8,776,419 B2 (IPC F4A9/61, publ. 23 Mar. 2012). The known double-stack magazine has a tubular body defining an elongated passage, a lower and an upper side, a floor plate wall connected to the lower end, a separator within the elongated passage which is set distantly from the upper surface of the magazine box; a follower defining an aperture receiving the separator element and movable within the elongated passage; a spring within the passage having a first end contacting the floor plate, and having an opposed second end contacting and biasing the follower toward the upper end of the body; the magazine box consists of right and left side walls, in the middle of which there is a separator forming rows of ammunition. The disadvantages of the magazine according to U.S. Pat. No. 8,776,419 are that:

in the magazine receiver four upper ammunition with a staggered arrangement have a thrust, in addition to which the rotation of this ammunition is promoted during rearrangement;

the third ammunition of the right and left row forms two columns of ammunition with an incomplete staggered arrangement of ammunition in each column on the rear wall with the projection of the magazine's box. The thrust in the third cartridges is equal to the vertical force acting at this moment (depends on the loading of the magazine) on the ammunition divided by the cosine of the angle between the ammunition forming the incomplete staggered order;

at all rear ends of ammunition below three with incomplete staggered order will occur the thrust, in this case, the front ends of the ammunition will be without thrust;

trash (dust, dirt, sand, etc.) will fall into the grooves formed by the rear wall with the projection of the magazine box and will be settled on the ammunition contained in them. Trash accumulating on ammunition on the friction surfaces will increase friction, which can lead to cessation of magazine operation;

all of the above will lead to the rising of high force of friction and reducing reliability, especially in difficult usage environment;

the complexity of construction, consisting of parts with a complex configuration that will not allow the use of stamping, thereby increasing the cost of manufacturing.

Therefore, a need exists for a new magazine construction for use in small arms to provide a high rate of firing. It is desirable to have a simple magazine, with light loading and recharging of ammunition, without contaminating internal soils, which makes it possible to simplify the operation of the magazines and to increase the reliability of the weapon as a whole without reducing the required firing rate.

The use of the proposed construction of a box magazine for small arms will achieve a technical result of increasing reliability, reducing the ammunition feed effort, which is provided by reducing friction in the magazine, due to removing side thrust from all ammunition except the upper three, which are staggered, and reducing of friction surfaces up to four points on a single ammunition. The magazine also contains a large number of cavities where dirt can accumulate, without interfering with the normal operation of the magazine.

According to the proposed invention the solution of the stated problem is achieved by the fact that in a magazine for small arms, which comprises a box made in the form of a tube of rectangular cross-section, at the top of which feed projections for fixing the ammunition are made, and a projection is made on one of the narrow side walls of the box for fixing the magazine to the weapon, a bottom lid with an opening, a magazine follower with a rectangular opening and a cylindrical protrusion, a coil spring, disk with rectangular through hole is installed between follower and coil spring, which presses the upper end of the coil spring to the follower, ammunition stream separator within the follower hole and located inside the coil spring. According to the invention, in addition there are grooves along the wide side walls of the magazine box, on the inner surfaces facing the ammunition a ground surface is made, wherein in the lower part of the box of the magazine, on the outer surface there is a triangular ledge, and in upper part of magazine box on wide side walls there are rigidly fixed plate inserts, on which the feeding projections are made, the polished section and the conical section, the feeding projections on the plate inserts are made at an angle equal to the angle of inclination of the handle on the weapon, measured with respect to the vertical axis of the weapon;

magazine follower is made in the form of plate with the middle part and long bent end and short bent end, grooves are made on outer surface of long bent end and short bent end, at the bottom of the long bent end and the short bent end there is projection for fixing the follower in the magazine box, rectangular-section tube is made at the bottom of the middle part in the middle;

ammunition stream separator is made in form of a long plate whose side surface facing ammunition is provided with sliding sections, in which there is a through the groove, and the upper part of the said plate is made with a pointed end.

Furthermore, projections are made in the lower end of the magazine box along the wide side walls.

Furthermore, the height of the grooves along the wide side walls of the magazine box equals 0.138 of the outer diameter of the ammunition.

Furthermore, the width between adjacent grooves along the wide side walls of the magazine box equals 2.3 of the outer diameter of the ammunition.

Furthermore, the width between adjacent plate inserts equals 1.88 of the outer diameter of the ammunition.

Furthermore, the length of the polished section equals 1.222 of the outer diameter of the ammunition.

Furthermore, the polished section on the plate insert passes into the conical section.

Furthermore, the conical section is arranged at an angle of five degrees with respect to the vertical axis of the magazine.

Preferably, the upper surface of the disk is inclined and has an angle equal to the angle of inclination of the handle to the weapon.

Preferably, the middle part of the follower plate is inclined towards the short bent end with an angle equal to the angle of inclination of the handle, measured relative to the vertical axis of the weapon.

Furthermore, the cylindrical protrusion is located at the top of the edge of the middle part of the follower plate.

Preferably, the depth of the groove on the outer surface of the long bent end and the short bent end equals 0.06 of the outer diameter of the ammunition.

Furthermore, the height of the projections from the bottom of the long bent end and the short bent end equals 0.1 of the outer diameter of the ammunition.

Furthermore, the height of the cylindrical protrusion equals half of the outer diameter of ammunition.

Furthermore, the height of the tube of rectangular section equals two outer diameters of the ammunition.

Besides, the width of the tube of rectangular section equals the internal diameter of the coil spring in the uncompressed free state.

Preferably, a projection is provided on the lower end of the long plate for fixing the bottom lid.

Furthermore, the ends of the long plate are made radial.

Furthermore, the thickness of the long plate equals 0.1 of the outer diameter of the ammunition.

Furthermore, the surface of the upper part of the long plate is skewed at an angle equal to the angle of inclination of the handle on the weapon, measured with respect to the vertical axis of the weapon.

Furthermore, the pointed end is made with an angle of five degrees.

Furthermore, the through groove starts from the pointed end at a distance equal to the outer diameter of the ammunition.

Furthermore, the length of the through groove equals 0.5*N*D, where N is the number of ammunition in the magazine, D is the outer diameter of the ammunition.

It is preferable that cavity is formed between ammunition and a long plate of ammunition stream separator, between ammunition and inner walls of magazine box with grooves along wide side walls and in space portion of magazine bounded by fully compressed coil spring.

It is preferable that the follower fixes the ammunition stream separator in the middle inside the box of the magazine, said ammunition stream separator guiding the reciprocating motion of the follower.

The technical character of an invention is explained in the drawings where:

The arrangement and operation of the magazine that is claimed as the invention have been described with regard to inputted components and fragments, shown in FIGS. 1-15, as well as the above-stated combinations of main and additional features.

Figure 1:
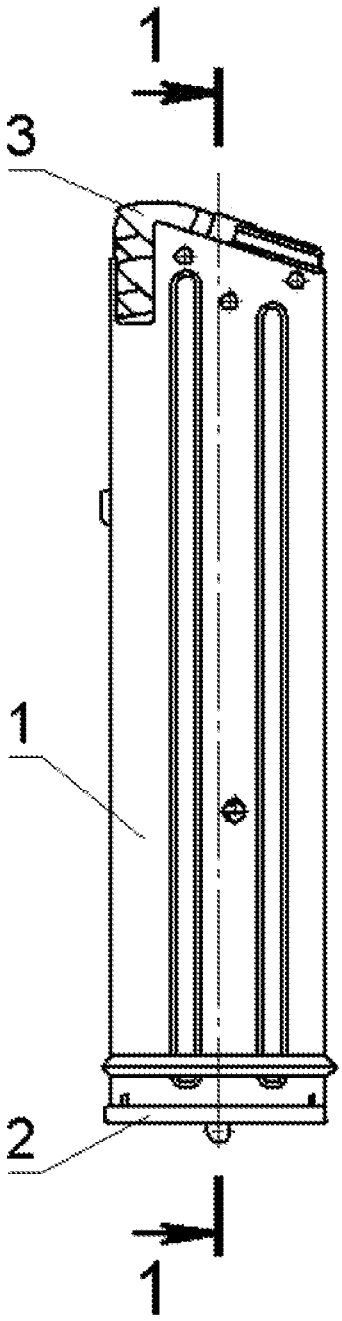
FIG. 1 shows a magazine for firearms (side view).
Figure 2:
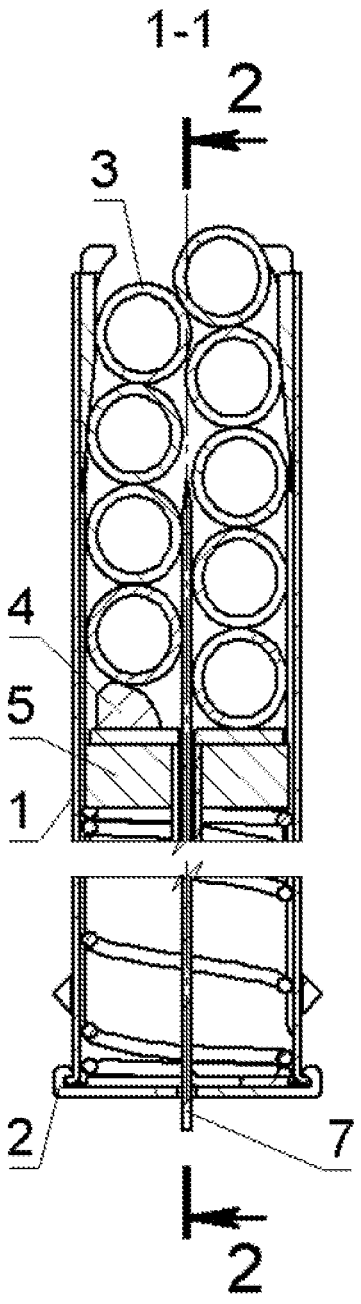
FIG. 2 is a sectional view 1-1 in FIG. 1.
Figure 3:
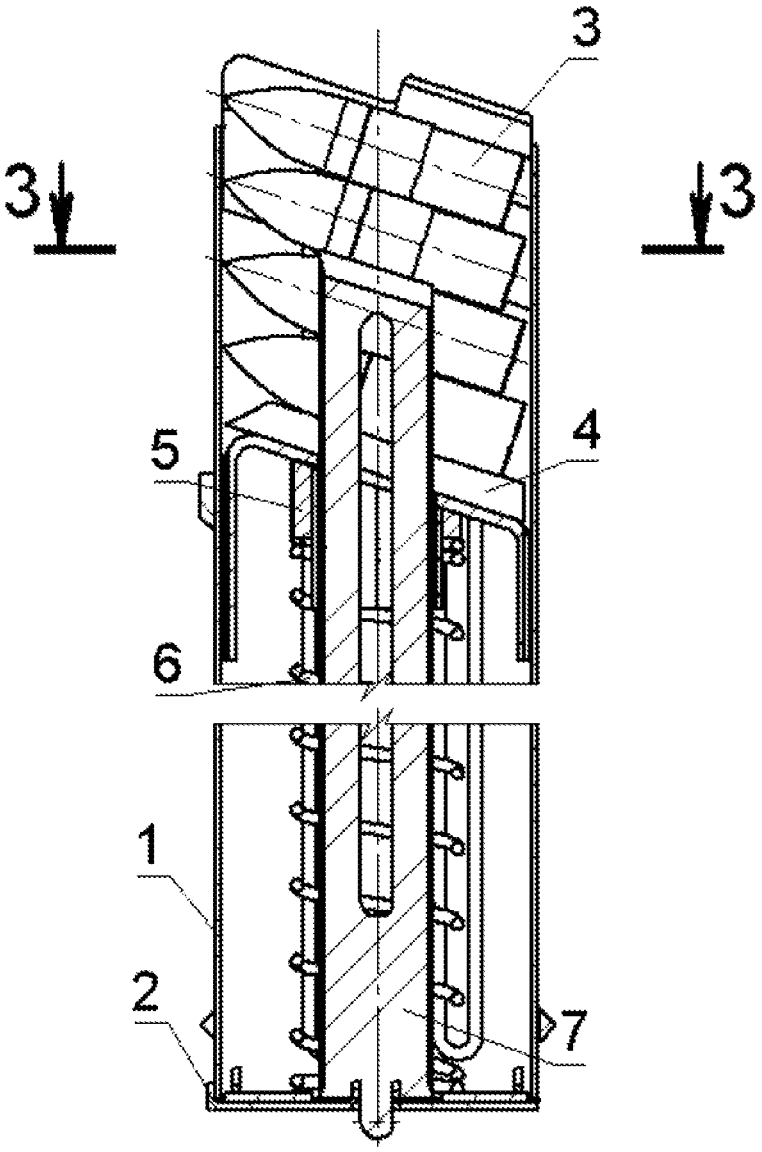
FIG. 3 is a sectional view 2-2 in FIG. 2.
Figure 4:
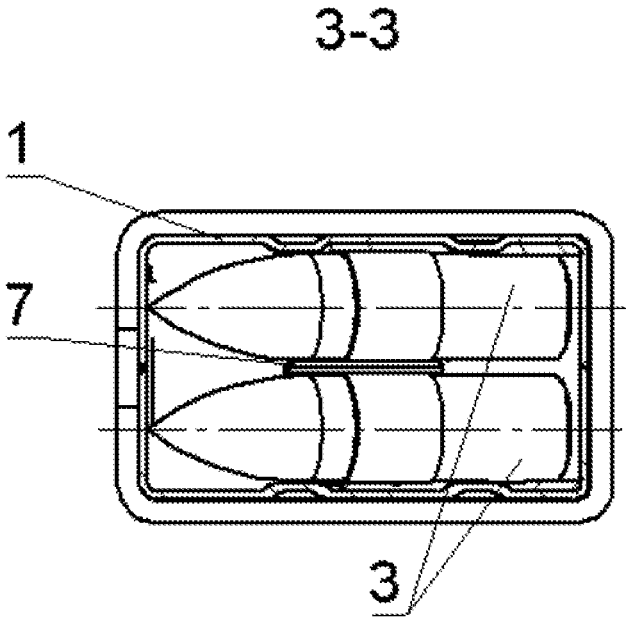
FIG. 4 is a sectional view 3-3 in FIG. 3.

The following is a detailed description of the invention:

FIG. 1-3: the magazine comprises a box 1, a bottom lid 2 with the opening, ammunition 3, follower 4, disk 5, the coil spring 6, the separator 7.

Figure 5:
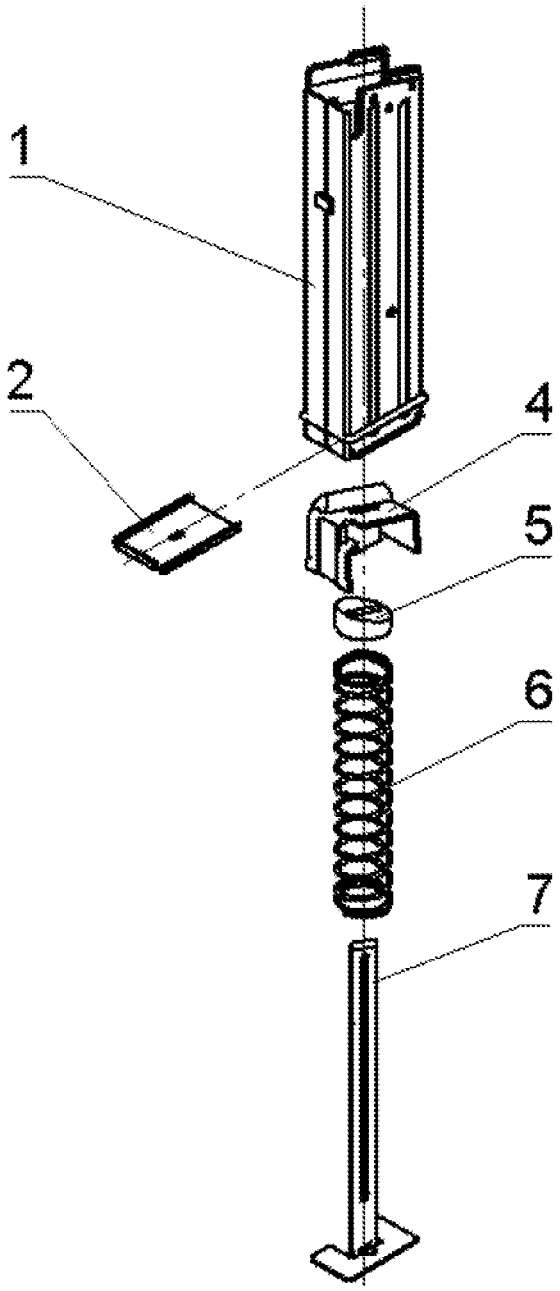
FIG. 5 shows a detail of the magazine (side view).
Figure 5A:
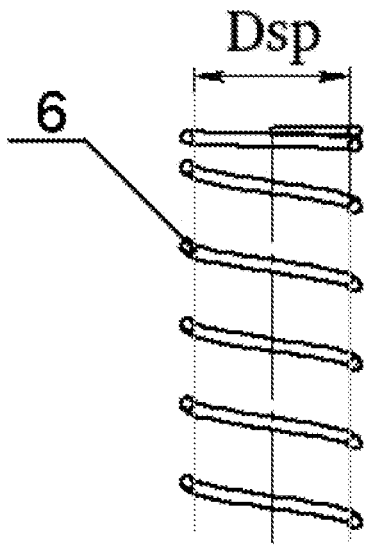
FIG. 5A shows the spring in an expanded and free condition.
Figure 6:
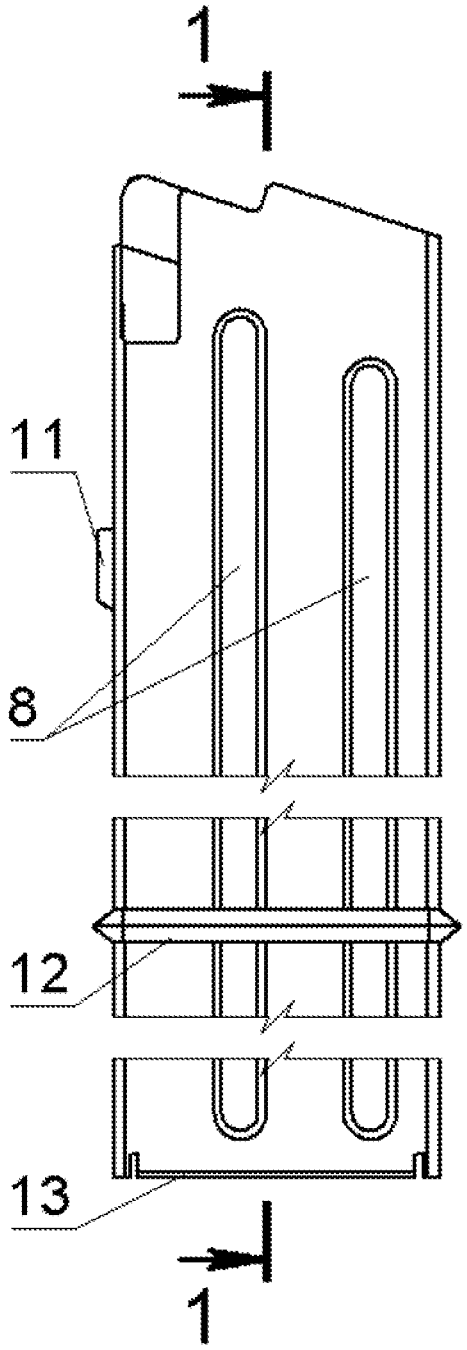
FIG. 6 shows a box magazine (side view).
Figure 7:
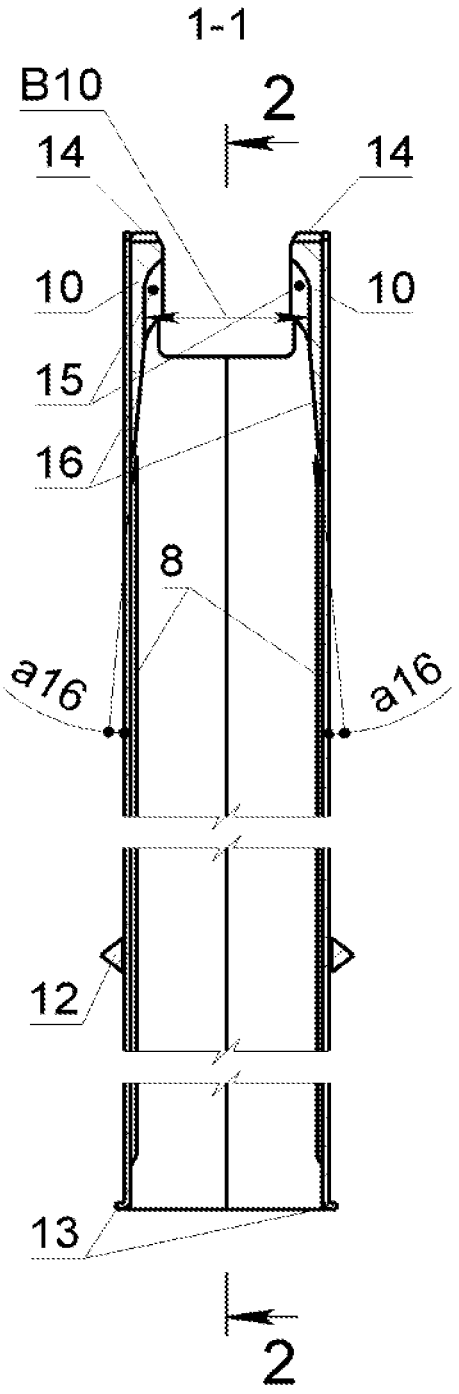
FIG. 7 shows a sectional view 1-1 in FIG. 6.
Figure 8:
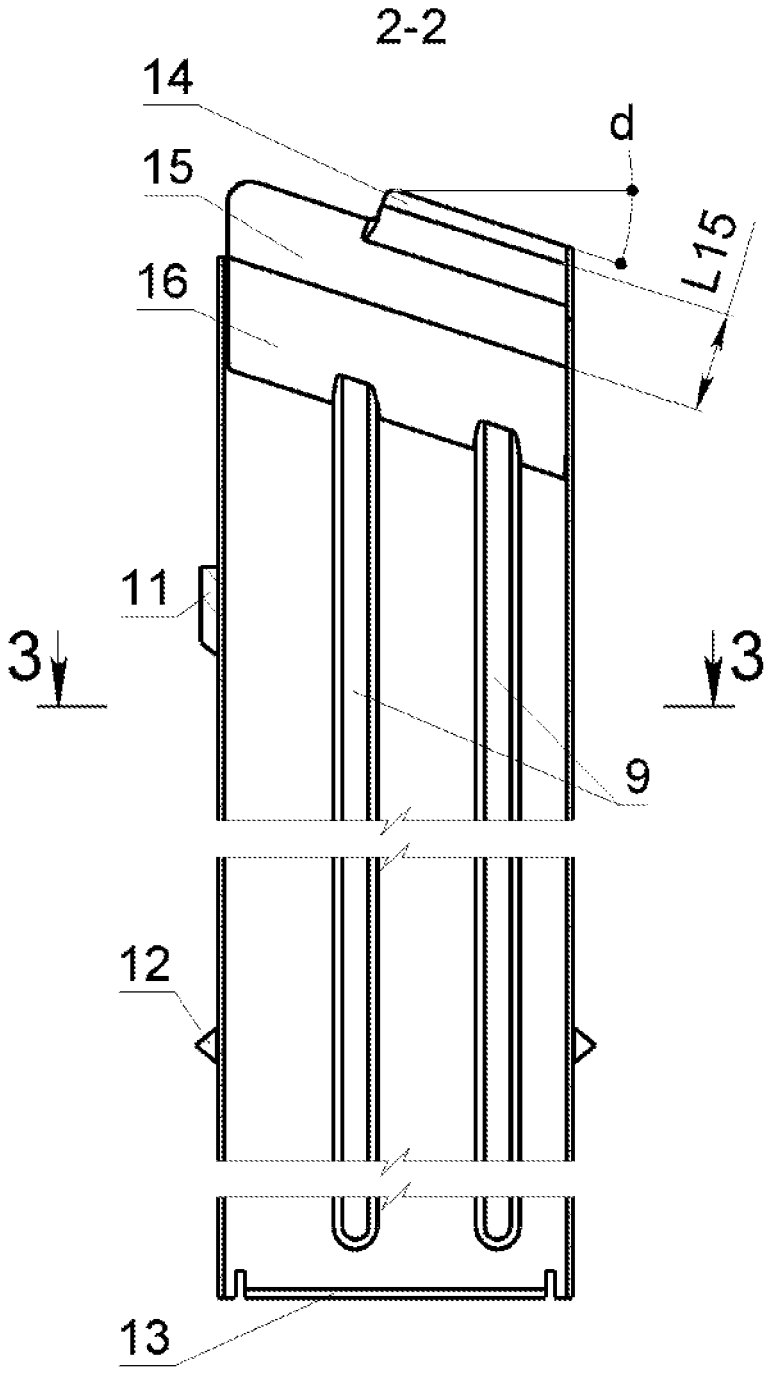
FIG. 8 is a sectional view 2-2 in FIG. 7.
Figure 9:
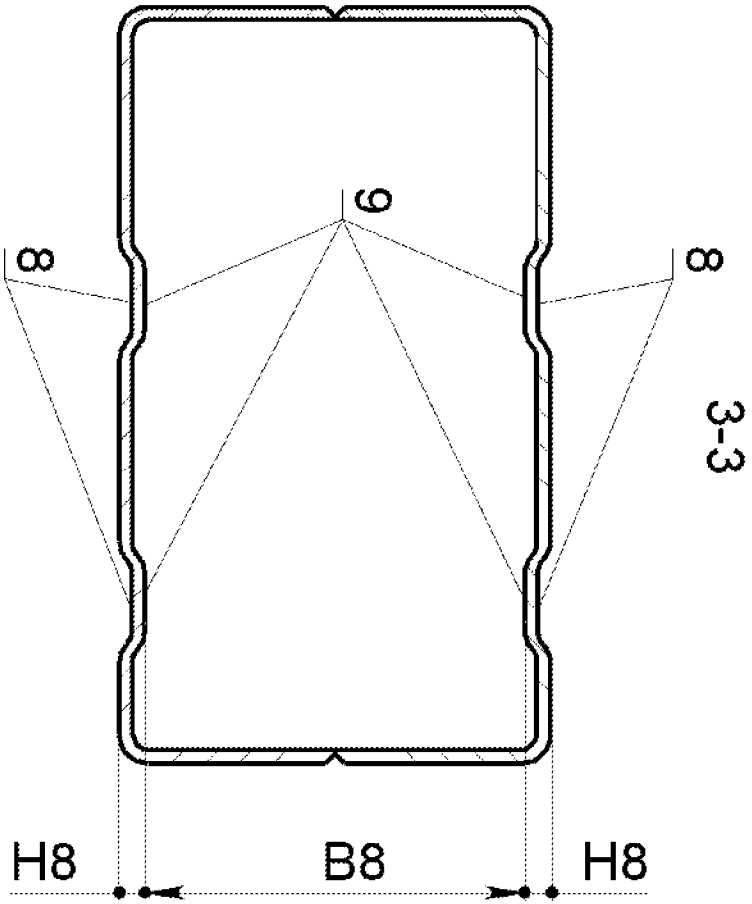
FIG. 9 is a sectional view 3-3 in FIG. 8.

FIG. 5 shows a detail of the magazine. This configuration consists of a box 1, a bottom lid 2 with the opening, a follower 4, a disk 5, a coil spring 6, a separator 7. The follower 4 is fixed by the stream separator 7 and stream separator 7 acts as a sliding guide of the long plate 29 during movement of the follower 4 inside the box magazine 1. The coil spring 6 is located between the wide side walls of the box magazine 1 and touches two points tangentially to these walls, and slides on the radial ends of the long plate 29 of the stream separator 7. FIG. 5A shows the inner diameter of the spring in expanded and free condition.

FIG. 6-9: Box 1 is in the form of a tube of rectangular cross section, with grooves 8 along the wide side walls, inwardly the box 1. Height of grooves 8 equals H8=0.138*D, where H8 is the height of the grooves 8, D is the outer diameter of the ammunition 3. A cavity 36 is formed in response to the grooves 8 between the ammunition 3 and the inner walls of the box 1 for passage of dirt, sand into the lower part of the box 1, which reduces the friction during the feeding of ammunition 3, thereby increasing the reliability of operation of the magazine. The width of B8 between adjacent grooves 8 equals 2.3*D, in response to this value all ammunition 3 below the fourth charged ammunition 3 will lie precisely in the vertical order. Inside the box 1 in the grooves 8 The ground surface 9 is located inside the box 1 in the grooves 8 to reduce the sliding friction of the ammunition 3. Plate inserts 10 are located in the upper part of the box 1 and rigidly fixed on the wide side walls of the box 1. On one of the narrow side walls of the box 1, closer to the top, there is a projection 11 for fixing the magazine to the weapon. In the lower part of the box 1, on the outer surface is a triangular ledge 12. The triangular ledge 12 serves for fixing the magazine into the firearm and shutting off dirt, sand in the magazine. The triangular shape of the ledge 12 due to a wedging action promotes tight sealing the joint of the magazine-receiver of the magazine. The projections 13 under the lid 2 are provided at the lower end of box 1 along the wide side walls. Feed projections 14 are provided in the plate inserts 10 for fixing the ammunition 3 on ramming line into the cartridge chamber, polished section 15 on which the ammunition 3 are staggered. The width of B10 between the adjacent plate inserts 10 equals 1.88*D, the three upper ammunition 3 are always strictly in a staggered order due to such correspondence. The polished section 15 on the plate insert 10 passes into a conical section 16. The Conical section 16 is arranged at an angle D16 to the vertical axis of the magazine, equal 50 that allows the arrangement of the ammunition 3 from one-row to double-row positions without friction practically. The length L15 of the polished section 15 equals 1.222*D, due to this correspondence only the two upper ammunition 3 located on the polished section 15, which forms a clear feeding of the three upper ammunition 3 under the feed projections 14, which also prevents from the forming of thrust force below the three upper ammunition 3. The feed projections 14 are made at an angle d, equals the angle of inclination of the handle on the weapon, measured with respect to the vertical axis of the weapon, when the magazine is in the handle. The conical section 16, with the inner grooves 8 on the magazine walls, participates in the arrangement of the ammunition 3 into a staggered order.

Figure 10:
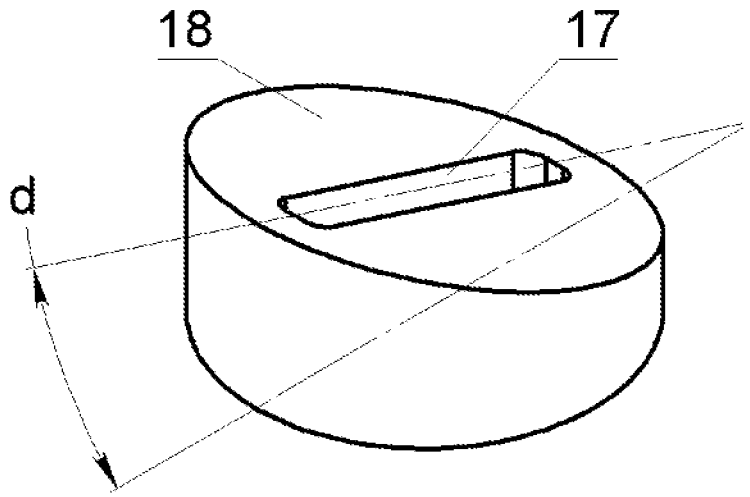
FIG. 10 shows a disk (side view).

FIG. 10. Disk 5 is made with a rectangular through hole 17. Rectangular through hole 17 serves to pass separator 7. Upper surface 18 of disk 5 is inclined by angle d, equals to the angle of inclination of the handle to the weapon, when the magazine is in the handle. The inclination is made so that when the inclination of the ammunition in the magazine is changed, the shape of the spring is not changed and create a strictly vertical force on the spring.

Figure 11:
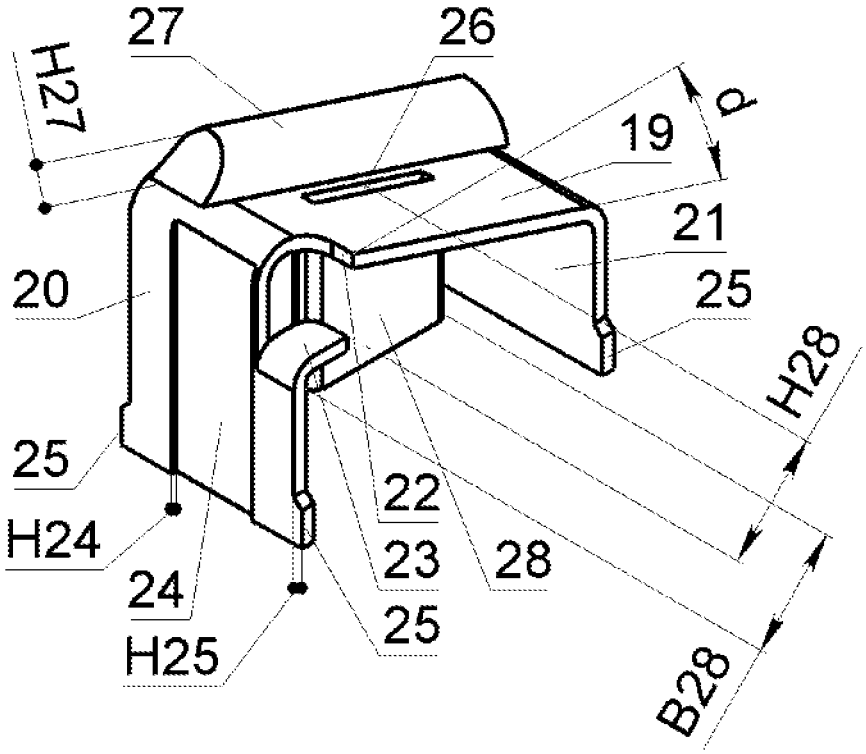
FIG. 11 shows magazine follower (side view).

FIG. 11 The follower 4 is in the form of a plate with a middle part 19 and bent ends, long bent end 20 and short bent end 21. Middle part 19 of follower 4 plate is inclined towards short bent end 21 with angle d, equals to the angle of inclination of the handle on the weapon, measured with respect to the vertical axis of the weapon when the magazine is in the handle. Groove 22 with projection 23 is made in long bent end 20 from above. Projection 23 is supposed to lift last round stopper on the weapon. Grooves 24 are formed on the outer surface of the long bent end 20 and the short bent end 21. The depth of the groove 24 is H24=0.06*D, where H24 is the depth of groove 24, D is the outer diameter of the ammunition 3. At the bottom of the long bent end 20 and the short bent end 21, projection 25 are made for fixing the follower in the magazine box. The height of the projection 25 is equal to H25=0.1*D, where H25 is the height of the projection 25, D is the outer diameter of ammunition 3. Due to the groove 24 and projection 25, a cavity 36 is formed between long bent end 20, the short bent end 21 and the inner walls of the box 1 for the passage of dirt, sand into the lower part of the box 1 which reduces friction when ammunition is feeding improving reliability of magazine operation. A rectangular opening 26 is formed in the middle of the middle part 19 of the follower 4 plate. A cylindrical protrusion 27 is formed on the top of the edge of the middle part of the plate 19, serving as the guide for ammunition 3. The height of the cylindrical protrusion 27 is equal to H27=0.5*D, where H27 is the height of the cylindrical protrusion 27, D is the outer diameter of ammunition 3. Due to cylindrical protrusion 27 of ammunition 3, displacement is obtained relative to rows equal to 0.5*D, so that the staggered order of the three upper ammunition 3 is formed. From the bottom of the middle part 19 of the plate in the middle, a tube of rectangular section 28 is made. The height of the rectangular section 28 equals H28=2*D, where H28 is the height of the tube of rectangular section 28, D is the outer diameter of the ammunition 3, which allows the separator 7, not fall out of the tube of rectangular section 28, after lifting the follower 4 to the upper position, otherwise, it is possible to jam the separator 7 in the follower 4. The width of the tube of rectangular section 28 equals B28=Dsp, where B28 is the width of the tube of rectangular section 28, Dsp is inner diameter of coil spring 6 in expanded and free condition, due to this value, coil spring 6 is freely put on tube of rectangular section 28, a minimum gap between the inner diameter of the spring 6 and the tube of rectangular section 28 is formed in the completely compressed coil spring 6. The rectangular opening 26 and the tube of rectangular section 28 serve to pass the separator 7.

Figure 12:
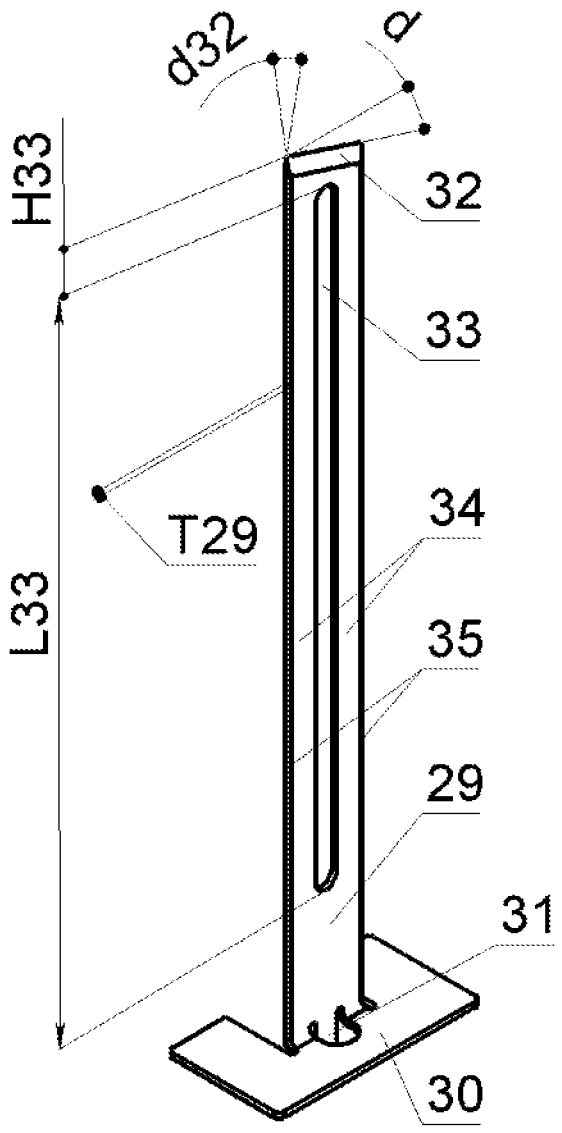
FIG. 12 shows ammunition stream separator (side view).

FIG. 12: The separator 7 is made in the form of long plate 29 whose lower end is bent and forming the base 30. The base 30 repeats the shape of the box 1 so that the long plate 29 from the bottom is precisely fixed in the middle inside the box 1. The thickness of the long plate 29 equals T29=0.1*D, where T29 is the thickness of the long plate 29, D is the outer diameter of the ammunition 3. Due to the thickness of the long plate 29 between the ammunition 3, a cavity 36 is formed for passing dirt and sand in the lower part of box 1, which reduces friction when ammunition is feeding, improving the reliability of magazine operation. A projection 31 is provided at the lower end of the long plate 29 for fixing the bottom lid 2 to the place. The upper part of the long plate 29 is made at an angle d equal to the angle of inclination of the handle on the weapon, measured relative to the vertical axis of the weapon when the magazine is in the handle. In the upper part of the long plate 29, pointed end 32 is made. Pointed end 32 with angle D32 equal to 50 degrees makes it possible to arrange ammunition 3 from one-row arrangement to double-row in staggered order practically without friction. A through groove 33 is formed behind the pointed end 32, which serves to assemble the magazine and reduces the sliding sections 34, formed by the through groove 33 in the long plate 29. The through groove 33 begins at a distance D from the pointed end 32, where D is the outer diameter of the ammunition 3. The diameter of the through groove 33 equals L33=0.5*N*D, where L33 is the length of the through groove 33, N is the number of ammunition in the magazine, D is the outer diameter of the ammunition 3. Due to the installed length L33 of the through groove 33, all ammunition 3 in the magazine receiving in the separator 7 will be located in the sliding section 34. The sliding sections reduce the friction of the side surfaces of ammunition 3. The ends 35 of the long plate 29 are made radial to reduce the friction of the turns of the coil spring 6 during its operation.

Figure 13:
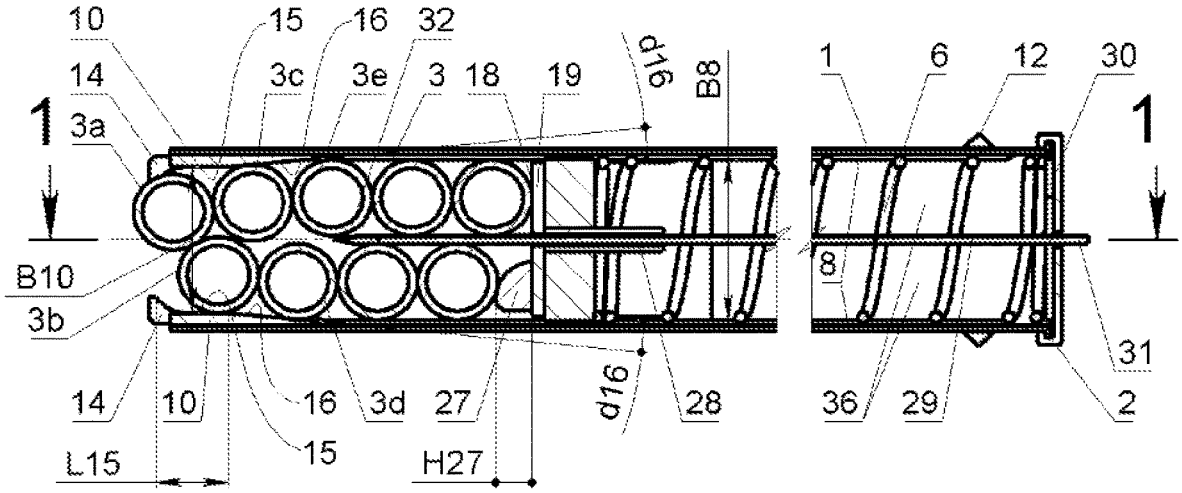
FIG. 13 is a cross-sectional view of the magazine.
Figure 14:
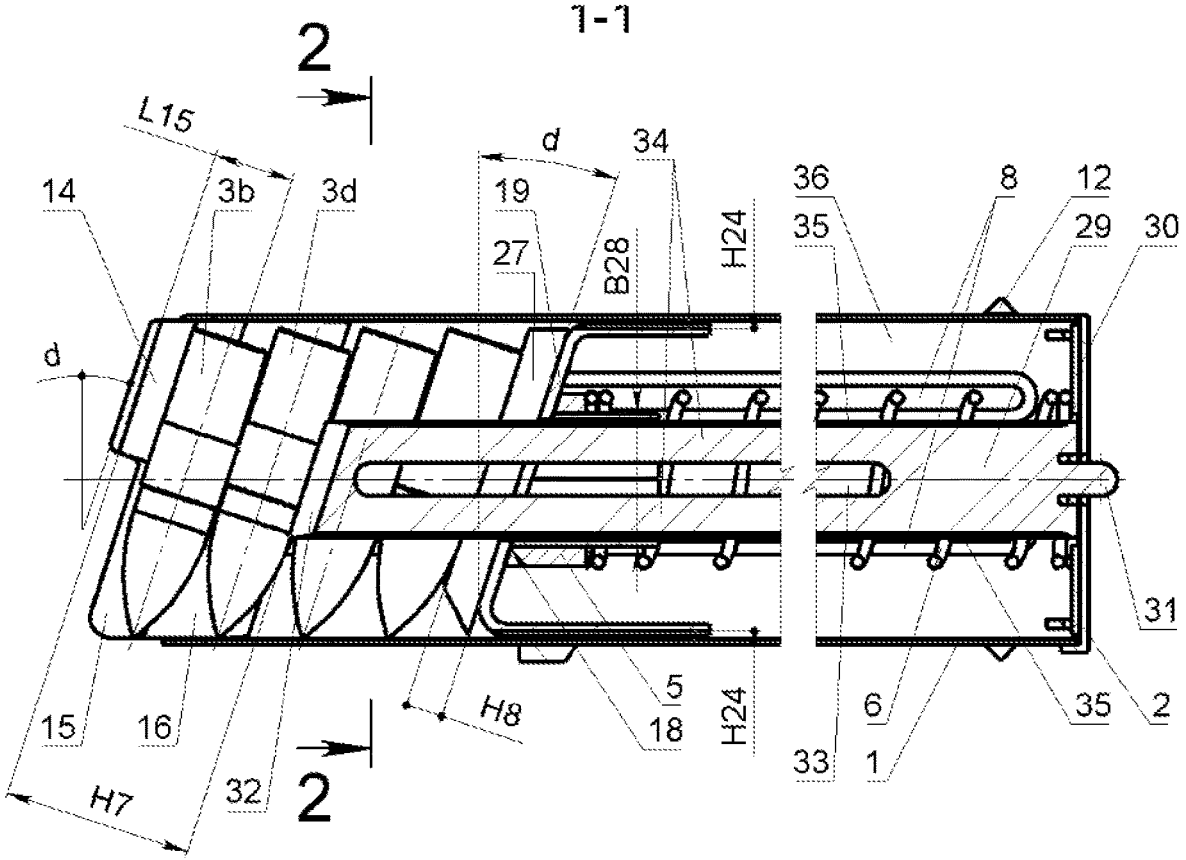
FIG. 14 is a sectional view 1-1 in FIG. 13.
Figure 15:
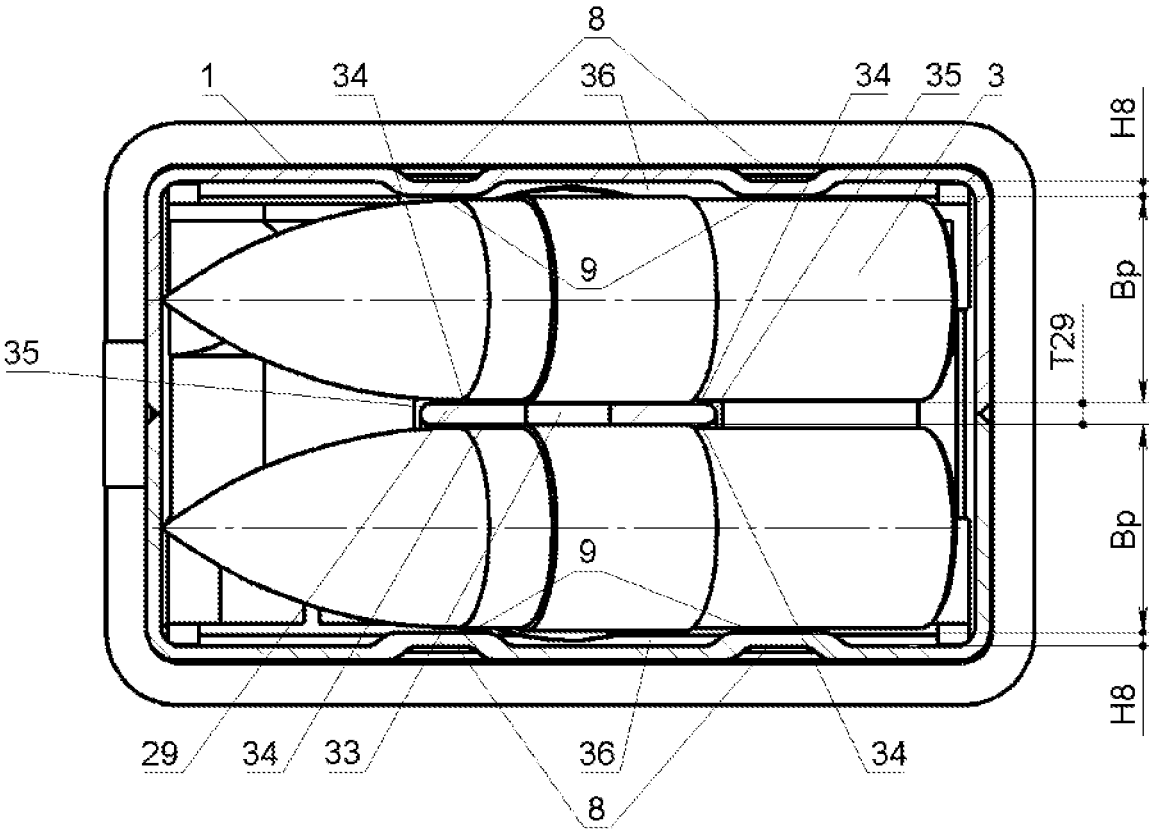
FIG. 15 is a sectional view 2-2 in FIG. 14.

FIG. 13-15: Between ammunition 3 and long plate 29 of ammunition stream separator 7, between ammunition and inner walls of magazine box with grooves 8 along wide side walls and in part of magazine space, defined by the fully compressed coil spring 6, a cavity 36 is formed for passing dirt, sand into the lower part of the box 1, which reduces friction during feed of ammunition 3, thus improving reliability of magazine operation.

The lower end of the coil spring 6 pushes the base 30 of the separator 7 to the bottom lid 2 with the opening and the projection 31 at the lower end of the long plate 29 of the separator 7 and fixes the bottom lid 2 with the opening in its hole.

During the shooting the feed piece grips the upper ammunition 3*a* from under the feed projection 14 of the plate insert 10, boxes 1 and put it into cartridge chamber. Since the ammunition 3*a*, 3*b*, 3*c* between the plate inserts 10 of the box 1 are staggered, then they are fed alternately from the right and left rows, the follower 4 feeds the ammunition 3 under the action of the coil spring 6. In this case, the first three ammunition 3*a*, 3*b*, 3*c* on top of the magazine slide along the polished section 15 in the plate inserts 10 of the box 1. The length L15 of the polished section 15 is 1.222*D, due to this value, only two upper ammunition 3*a*, 3*c* are located in the polished section 15 and form a clear feed of the three upper ammunition 3*a*, 3*b*, 3*c* under the feed projections 14, in the same way, the length L15 does not give rise to a thrust force below the three upper ammunition 3*a*, 3*b*, 3*c*. The width B10 between adjacent plate inserts 10 is 1.88*D, and the height of the cylindrical protrusion 27 on the follower 4 is equal to 0.5*D-so that the ammunition 3 produces the displacement relative to the rows of 0.5D, and form the staggered order of the three upper ammunition 3*a*, 3*b*, 3*c*. This three ammunition 3*a*, 3*b*, 3*c* may acquire lateral thrust from the vertical component, due to the existence of tolerances on ammunition in their manufacture, which will lead to friction. Behind the three upper ammunition 3*a*, 3*b*, 3*c* the next fourth ammunition 3*d* falls into the conical section 16 formed by the plate inserts 10 of the box 1, and is suitable to the pointed end 32 of the separator 7 and begins to rearrange to one of the cavities formed between the ground surfaces 9 of the grooves 8 of the box 1 and the sliding section 34 of the long plate 29 of the separator 7, in this case, width B8 between adjacent grooves 8 is 2.3*D, due to this value all other ammunition 3 below the fourth charged ammunition 3*d*, will be strictly in the vertical order. A ground surface 9 is provided inside the box 1 on the grooves 8 to reduce friction when the ammunition 3 is slid. The conical section 16 on the plate inserts 10 and the pointed end 32 are made at an angle d16=d32=50 to the vertical axis of the box 1, which makes it possible to carry out the transition of the ammunition 3 from the row arrangement to the double-row in a staggered order practically without friction. Conical section 16 on plate inserts 10 with inner grooves 8 of magazine walls and pointed end 32 of separator 7 rearranges ammunition 3 in staggered order, at that the ammunition 3 rearrange from the row to the double-row arrangement and they are only moved to each other without being clinched between the rows, thereby increasing the reliability of ammunition feed 3. The pointed end 32 of the separator 7 begins at a distance H7=2.32*D from the inner side of the feed projection 14, where H7 is the distance from the inner side of the feed projection 14 to the pointed end 32 of the separator 7, D is the outer diameter of the ammunition 3, due to that distance the ammunition 3 is not wedged when returning in a staggered order. Behind the four upper ammunition 3*a*, 3*b*, 3*c*, 3*d* the next fifth ammunition 3*e* will be in the corresponding cavity already rearranged into the row order. All the ammunition 3 below the fifth will be not in staggered order, forming a vertical column in the respective cavities. Starting from the fifth ammunition 3*e*, all ammunition 3 only have a vertical component and do not have thrust. The thrust remains only in the three upper ammunition 3*a*, 3*b*, 3*c*, which are in staggered order. The ammunition 3 in the vertical column are fixed by the long plate 29 of the separator 7, which does not allow them to be rearranged into a staggered order and acquire the thrust. In this case, only four contact zones are formed for ammunition 3 located in the vertical column—two sliding platforms on the ground surfaces 9 of grooves 8 of box 1, and two sliding platforms, which are the sliding sections 34 of the long plate 29 of the separator 7. The sliding sections 34 have a minimum width due to the through groove 33, which reduces the friction of ammunition 3 in these sections. The width of the row Bp formed between the projection of groove 8 of the box 1 and the long plate 29 of the separator 7 is 1.1*D, where D is the outer diameter of ammunition 3, due to this value all remaining ammunition 3, below the fourth row, will be strictly in the vertical order. In operation of magazine, coil spring 6 is located between wide side walls of box 1 and contacts by two points along tangent with these walls, and slides along the radial ends 35 of the long plate 29 of the separator 7, which makes it small contact area and reduces friction of coil spring 6 to minimum value. In this case, the long plate 29 of the separator 7 prevents the compression of the coil spring 6 in the direction of the long side of the box 1, which makes it possible to use a coil spring for all kinds of magazines (pistol, automatic, gun-machine gun). The coil spring 6 is put on tube of rectangular section 28 by its upper end and rests against disk 5, the width of the tube of rectangular section 28 is B28=Dsp, where B28 is the width of the tube of rectangular section 28, Dsp is inner diameter of coil spring 6 in an expanded and free condition, due to this value, coil spring 6 is freely put on tube of rectangular section 28, and with a fully compressed coil spring 6, a minimum gap is formed between the inner diameter of the spring 6 and the tube of rectangular section 28. Upper surface 18 of disk 5 is made with inclination, the angle of inclination d is equal to the angle of inclination of the handle to the weapon when the magazine is in the handle. The inclination is made so that when the inclination of the ammunition 3 in the boxes 1 is changed, the shape of the coil spring 6 does not change and a strictly vertical force is created on the spring. The long plate 29 of the separator 7 is made equal to T29=0.1*D, where T29 is the thickness of the long plate 29, D is the outer diameter of the ammunition 3, so that a cavity 36 is formed between the ammunition 3 for passing dirt, sand in the lower part of the box 1, which reduces the friction when the ammunition 3 is fed, thereby improving the reliability of the magazine. Similarly, grooves 8 form cavity 36 between ammunition 3 and inner walls of box 1 and cavity 36 is formed in part of space of box 1, where the fully compressed coil spring 6 is located, it is there to accumulate all dirt, which does not interfere with the normal operation of the magazine. The lower end of coil spring 6 pushes base 30 of separator 7 to bottom lid with opening 2 and projection 31 of separator 7 and locks bottom lid with opening 2 in its hole. All of the above described increases the reliability of its operation in the proposed magazine and reduces the feed force of ammunition.

The proposed magazine is used in the following manner. When magazine is charged, ammunition 3 is inserted into middle part 19 of follower 4 plate, the first ammunition 3 is pressed and the first ammunition 3 is placed under the feed projection 14 of the plate insert 10 of the box 1. When the second ammunition 3 is taken, the cylindrical protrusion 27 of the follower 4 is pressed onto the cylindrical protrusion 27 of the follower 4, which is a guide of ammunition 3. When the following ammunition 3 is taken, the upper ammunition 3 is pressed and placed under the feed projection 14 of the plate insert 10 of the box 1. This operation is repeated until the magazine is filled. When the magazine is charged, the same processes are carried out as in operation only in the reverse order.

In the present invention, the construction of the magazine makes it possible to use it in the pistol grip, the ammunition does not transmit side force to the magazine walls and the spring requires less force to feed the ammunition.

The above-described example of the invention is provided by way of illustration only and should not be considered as limiting. Various modifications and variations may be made to the subject matter described herein, and without departing from the essence and scope of an invention as set forth in the following claims.

The invention claimed is:

1. A magazine for small arms comprising:

a box having a tube of rectangular section, the top of which having feed projections for retention of ammunition, a projection on one of a pair of narrow side walls of the box for fixing the magazine to a weapon;

a bottom lid having an opening;

a magazine follower with a rectangular opening and a cylindrical protrusion;

a coil spring, a disk is installed between the follower and the coil spring, the disc having a rectangular through hole, the disc connects the upper end of the coil spring to the follower;

an ammunition stream separator placed in the opening of the follower, the ammunition stream separator located inside the coil spring;

wherein grooves are made additionally along a pair of wide side walls of the box of the magazine, a ground surface of these grooves made on the inner surfaces facing to the ammunition;

a triangular ledge made on the external surface of the lower part of the box of the magazine;

plate inserts rigidly fixed to the wide side walls of the upper part of the magazine box, the feed projections, polished sections and conical sections are formed on the plate inserts;

the feed projections on the plate inserts are configured at an angle which correlates to an angle of inclination of the handle of the weapon, where the angle of inclination of the handle is measured with respect to the vertical axis of the weapon;

the magazine follower is a plate with a middle part, a long bent end and a short bent end, grooves are made on an outer surface of the long bent end and the short bent end, projections for fixing the follower in the box of the magazine are located at the bottom of the long bent end and the short bent end, a tube of rectangular section is located at the middle of the bottom of the middle part in the middle is a tube of rectangular section;

the stream separator is a long plate the long plate side surface is configured to face ammunition is provided with sliding sections, the long plate of the stream separator having an elongated through-groove, and the upper part of the long plate having a pointed end.

2. The magazine of claim 1, wherein a set of projections is made on the lower end of the wide side walls of the magazine box.

3. The magazine of claim 2, wherein a height of the grooves the wide side walls of the magazine box correlates to an outer diameter of the ammunition.

4. The magazine of claim 3, wherein a width between adjacent grooves along the wide side walls of the box correlates to an outer diameter of the ammunition.

5. The magazine of claim 4, wherein the width between adjacent plate inserts correlates to an outer diameter of the ammunition.

6. The magazine according to claim 5, wherein a length of the polished section correlates to an outer diameter of the ammunition.

7. The magazine of claim 6, wherein the polished section on the plate insert transitions into the conical section.

8. The magazine of claim 7, wherein the conical section is arranged at an angle of five degrees with respect to the vertical axis of the magazine.

9. The magazine of claim 1, wherein an upper surface of the disk is inclined and has an angle equal to the angle of inclination of the handle to the weapon.

10. The magazine of claim 1, wherein the middle part of the follower plate is inclined towards the short bent end with an angle equal to the angle of inclination of the handle measured with respect to the vertical axis of the weapon.

11. The magazine of claim 10, wherein the cylindrical protrusion is arranged at a top of the middle part of the follower.

12. The magazine of claim 1, wherein a depth of the groove on the outer surface of the long bent end and the short bent end correlates to an outer diameter of the ammunition.

13. The magazine of claim 12, wherein the bottom of the long bent end and bottom of the short bent end each have a projection with a height correlating to an outer diameter of the ammunition.

14. The magazine of claim 13, wherein a height of the cylindrical protrusion correlates to an outer diameter of the ammunition.

15. The magazine of claim 14, wherein a height of the tube of rectangular section of the follower correlates to an outer diameter of the ammunition.

16. The magazine of claim 15, wherein a width of the tube of rectangular section of the follower correlates to an inner diameter of the coil spring when the coil spring is in an expanded and free condition.

17. The magazine of claim 1, wherein a projection is provided at a lower end of the long plate for fixing the bottom lid.

18. The magazine of claim 17, wherein the edges of the long plate are rounded.

19. The magazine of claim 18, wherein a thickness of the long plate correlates to an outer diameter of the ammunition.

20. The magazine of claim 19, wherein the pointed end of the upper part of the long plate is inclined at an angle which correlates to the angle of inclination of the handle on the weapon when measured with respect to the vertical axis of the weapon.

21. The magazine of claim 20, wherein the pointed end is arranged at an angle of five degrees.

22. The magazine of claim 21, wherein the through-groove begins at a distance spaced from the pointed end.

23. The magazine of claim 22, wherein a length of the through-groove correlates to an outer diameter of the ammunition.

24. The magazine of claim 1, wherein a cavity is formed between the follower, long plate of the stream separator, the inner walls of the box magazine and the bottom wall such that the cavity is sized to retain a fully compressed coil spring.

25. The magazine of claim 1, wherein the follower locks the stream separator in the middle of the magazine box, said stream separator being a guide for reciprocating movement of the follower.

* * * * *